US005674094A

United States Patent [19]

Hutchinson, Jr. et al.

[11] Patent Number: 5,674,094

[45] Date of Patent: Oct. 7, 1997

[54] FLANGE PLUG CONNECTOR FOR MATING WITH A RIGHT ANGLE CONNECTOR

[76] Inventors: Richard D. Hutchinson, Jr., 7607 Montmartre Rd., Greensboro, N.C. 27409; Garry L. Brown, 2712 Fairidge Dr., Kernersville, N.C. 27284; Daines M. Self, Jr., 5214 Millstone Rd., Oak Ridge, N.C. 27310

[21] Appl. No.: 729,825

[22] Filed: Oct. 8, 1996

Related U.S. Application Data

[63] Continuation of Ser. No. 385,407, Feb. 8, 1995, abandoned.

[51] Int. Cl.[6] ..... H01R 13/64

[52] U.S. Cl. ..... 439/680

[58] Field of Search ..... 439/374, 680, 439/681

[56] References Cited

U.S. PATENT DOCUMENTS

| | | | |
|---|---|---|---|
| 3,493,916 | 2/1970 | Hansen | 339/17 |
| 3,944,316 | 3/1976 | Newman et al. | 339/111 |
| 4,036,544 | 7/1977 | Keglewitsch | 339/91 R |
| 4,046,444 | 9/1977 | Brorein | 339/91 R |
| 4,306,374 | 12/1981 | Wharrie | 46/33 |
| 4,448,467 | 5/1984 | Weidler | 439/681 |
| 4,759,730 | 7/1988 | Sappington et al. | 439/622 |
| 4,772,210 | 9/1988 | Venaleck | 439/55 |
| 4,913,667 | 4/1990 | Muz | 439/733 |
| 5,211,585 | 5/1993 | Douty et al. | 439/680 |
| 5,234,353 | 8/1993 | Scholz et al. | 439/289 |
| 5,288,243 | 2/1994 | Mergless | 439/357 |
| 5,332,397 | 7/1994 | Ingalsbe | 439/680 |
| 5,342,221 | 8/1994 | Peterson | 439/677 |
| 5,372,517 | 12/1994 | Levesque | 439/314 |
| 5,382,177 | 1/1995 | Hutchinson, Jr. et al. | 439/358 |

*Primary Examiner*—Gary F. Paumen

[57] ABSTRACT

A plug connector (10) has a main body (12) and contact silos (14) with contact receiving passages (22) therein. The two contact silos (14) on either end are D-shaped to provide polarization of the connector with respect to a matable connector. The connector (10) further comprises a flange (40) extending along a top wall of the connector (10). The flange (40) extends beyond the main body (10) parallel to, but spaced from, the contact silos (14). The flange (40) provides a stop to prevent improper orientation of the connector (10) during mating with the matable connector.

23 Claims, 6 Drawing Sheets

FLANGE PLUG CONNECTOR FOR MATING WITH A RIGHT ANGLE CONNECTOR

This application is Continuation of application Ser. No. 08/385,407 filed Feb. 8, 1995, now abandoned.

FIELD OF THE INVENTION

The invention relates to a plug connector having a flange to prevent improper orientation of the connector during mating with a matable connector.

BACKGROUND OF THE INVENTION

A typical plug connector for mating with a header connector has a polarizing feature to prevent improper mating. The connector has contact silos having contacts therein. The two contact silos on the end are D-shaped. The matable header connector has openings for receiving the contact silos. The two openings on the end are D-shaped and are oriented in the same manner as the D-shaped contact silos. The D-shaped silos are utilized to polarize the connectors so that proper mating can be achieved.

Under harsh environmental conditions such as high humidity, the housing material may become pliable and flexible due to water absorption. When visibility of the connectors are obstructed, it is possible for the connectors to be forced together in the wrong orientation. This allows the connectors to be improperly mated despite the polarizing feature. Improper mating can cause shorting resulting in burn-up.

What is needed is an additional stop to make sure the connectors are properly oriented prior to mating.

SUMMARY OF THE INVENTION

The present invention is directed to a plug connector having a main body and contact silos. The contact silos have contact receiving passages and contacts therein. The silos extend forwardly from the main body and the two silos on the end are D-shaped to provide polarization of the connector. The connector further includes a flange which extends from the main body, adjacent and parallel to the contact silos. The flange prevents the connector from being mated with a matable connector by engaging the circuit board on which the matable connector is mounted.

BRIEF DESCRIPTION OF THE DRAWINGS

Embodiments of the present invention will now be described by way of example with reference to the accompanying drawings, in which.

DETAILED DESCRIPTION OF THE INVENTION

Figure 1:
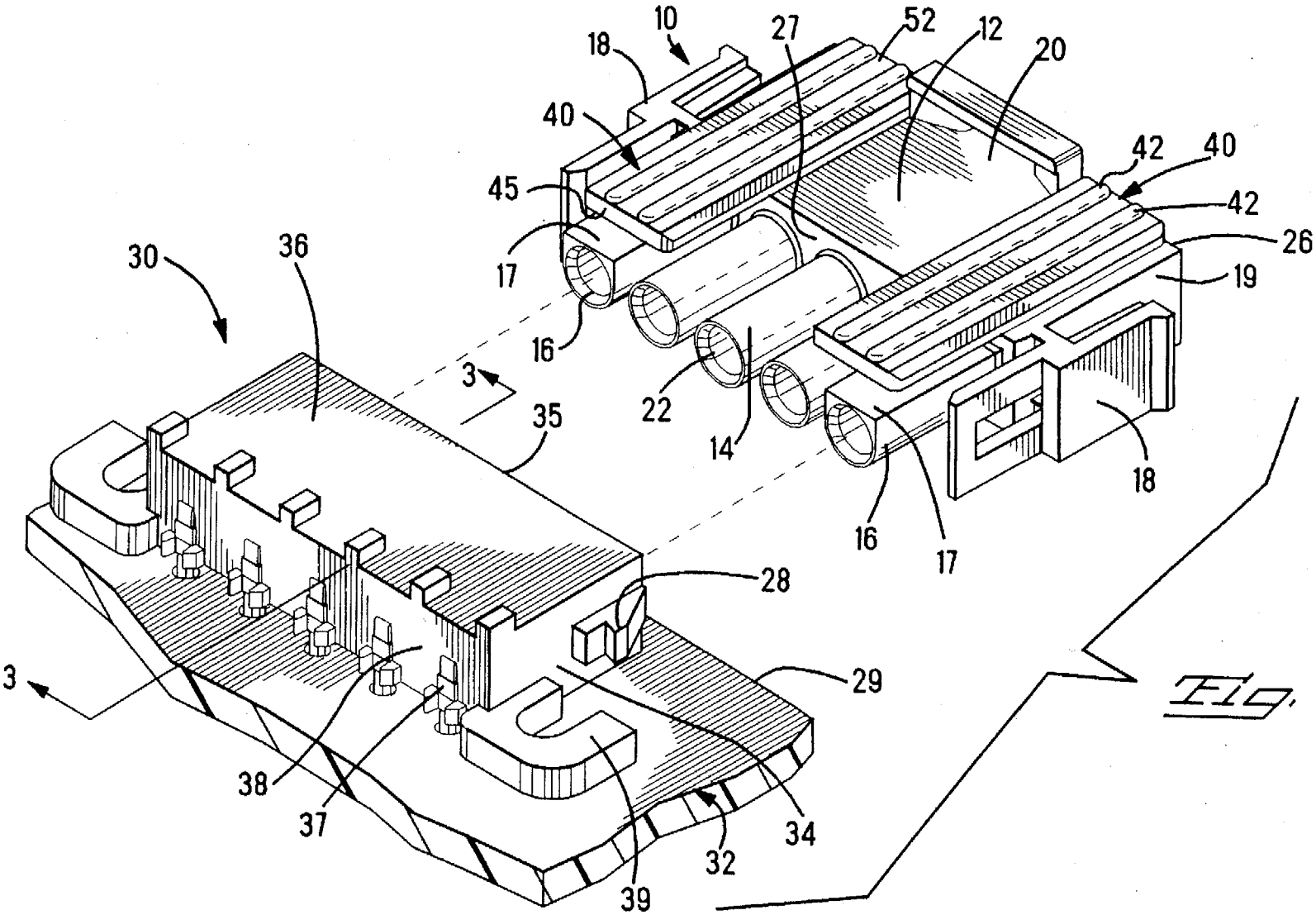
FIG. 1 is an exploded perspective view showing a plug connector, a right angle connector, and a circuit board.
Figure 2:
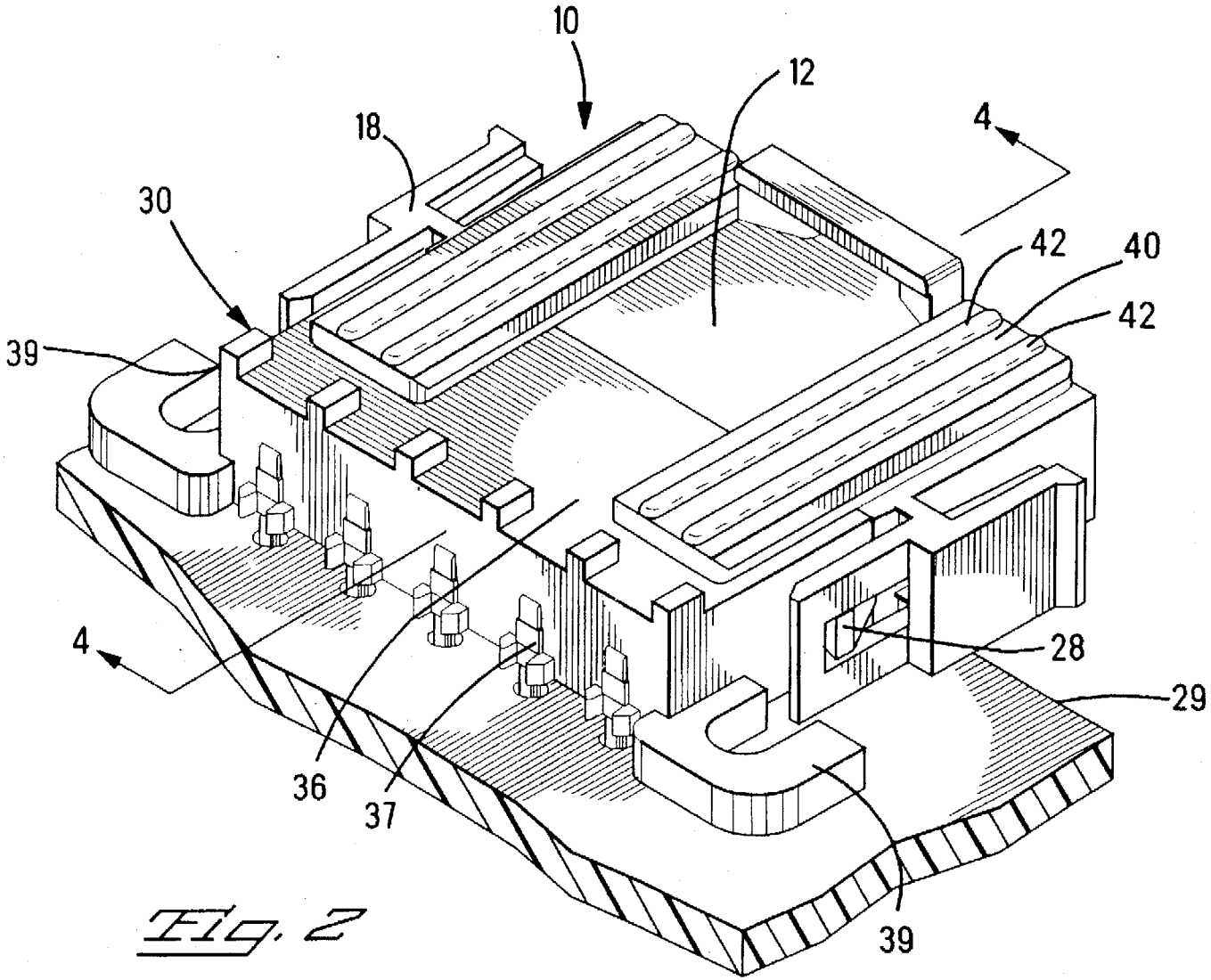
FIG. 2 is a perspective view showing the connectors mated.

A plug connector 10 of the present invention is shown in FIG. 1. The plug connector 10 is made of an insulative material and has a main body 12 having a top wall 20, side walls 19, a back wall 26 and a front wall 27. The side walls 19 have integral latching arms 18 for securing the plug connector 10 to a matable header connector 30. The front wall 27 has contact silos 14 extending forwardly therefrom. The contact silos 14 have contact receiving passages 22 extending therethrough, and through the main body 12 and the back wall 26. The contact receiving passages 22 have contacts 25 for making electrical connection with the contacts of the matable connector. The two contact silos on either end are in the form of D-shaped silos 16. The D-shaped silos 16 have flat surfaces 17 which are adjacent the top wall 20. The D-shaped silos 16 serve to polarize the connector to ensure proper mating between the plug connector 10 and the header connector 30. The connector 10 has five contact silos disposed in one row. The connector, alternatively, can have any number of silos and contacts disposed therein, and the silos can be arranged in more than one row. The connector need not have contact silos extending from the main body. The connector can have a main body with contact receiving passages therein. The flanges would extend along the top wall to act as a stop to prevent mating in an improper orientation.

The header connector 30 is mounted on a circuit board 32 to provide a right angle connection thereto. The header connector 30 has a mating face 35, passages 31 to receive the contact silos 14 of the plug connector 10, side walls 34, and a top wall 36. The passages 31 are similarly shaped as the contact silos 14 to ensure proper orientation of the plug connectors 10 during mating. The two end passages are D-shaped having flat surfaces adjacent to the top wall to receive the D-shaped silos. The passages have contacts 33 therein. The contacts 33 have tails 37 which extend from the back 38 of the header connector 30 to provide a right angle electrical connection to the circuit board 32. The header connector 30 has U-shaped arms 39 extending from side walls 34 which are used to secure the connector to the circuit board 32. The connector 30 is secured onto the circuit board 32 so that the mating face 35 is near, but not in alignment with, the edge 29 of the circuit board 32. The header connector 30 further has lugs 28 disposed along the side walls 34 to engage the latching arms 18 when the connectors are fully mated.

The plug connector 10 further has two flanges 40 disposed along the top wall 20. The flange 40 has two sections. The first section 48 extends along the top wall 20 of the main body 12. The second section 50 extends beyond the front wall 27 of the main body 12, parallel to but spaced from the contact silos 14. The second section 50 has a bottom wall 46 which is above the level of the top wall 20 of the main body 12. This insures that there is room to receive the top wall 36 of the header connector 30 underneath the flange 40. The flanges have top walls 52 with ribs 42 disposed therealong. The flanges 40 have a back edge which is aligned with the back wall 26 of the connector 10 and the ribs 42 extend from the back edge all the way to the front edge 45 of the flange 40. The ribs 42 provide the flanges 40 with structural support to prevent the flanges from warping. The flanges 40 do not extend as far away from the main body 12 as the contact silos 40.

Figure 3:
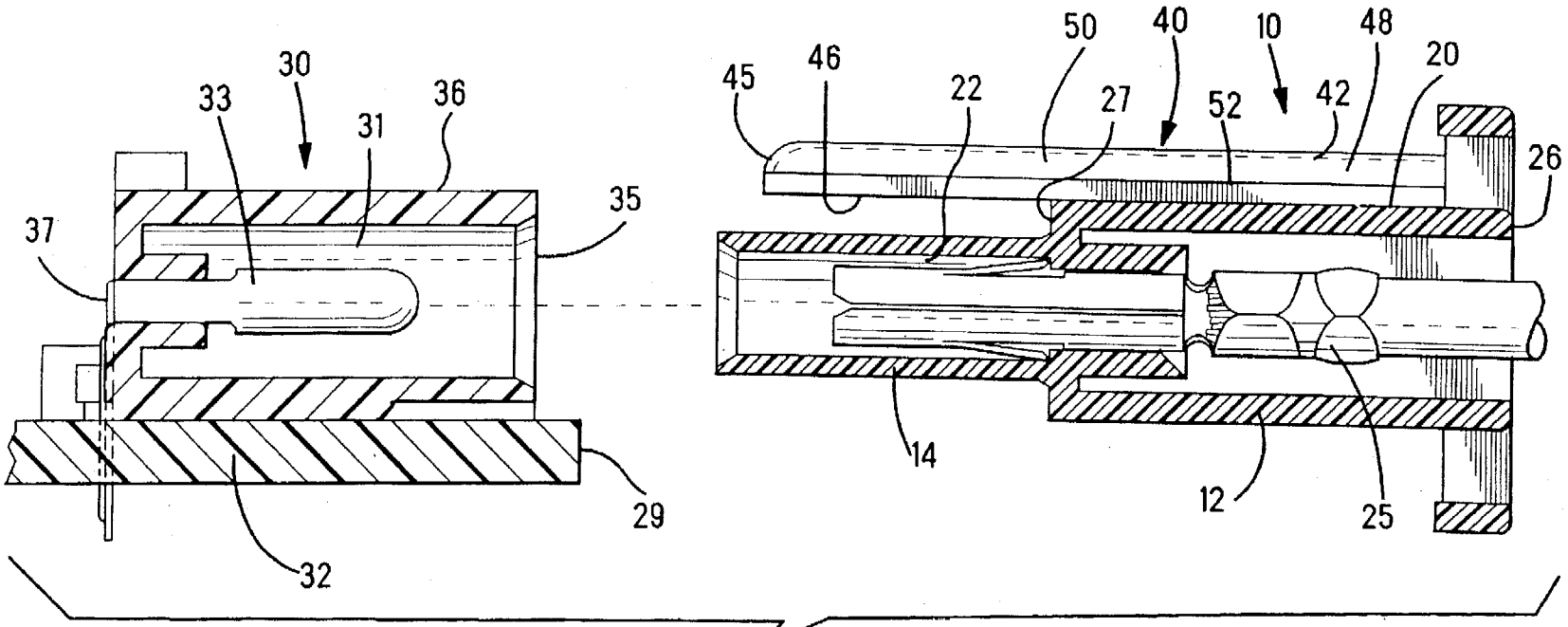
FIG. 3 is a cross-sectional view along the line 3—3 of FIG. 1.
Figure 4:
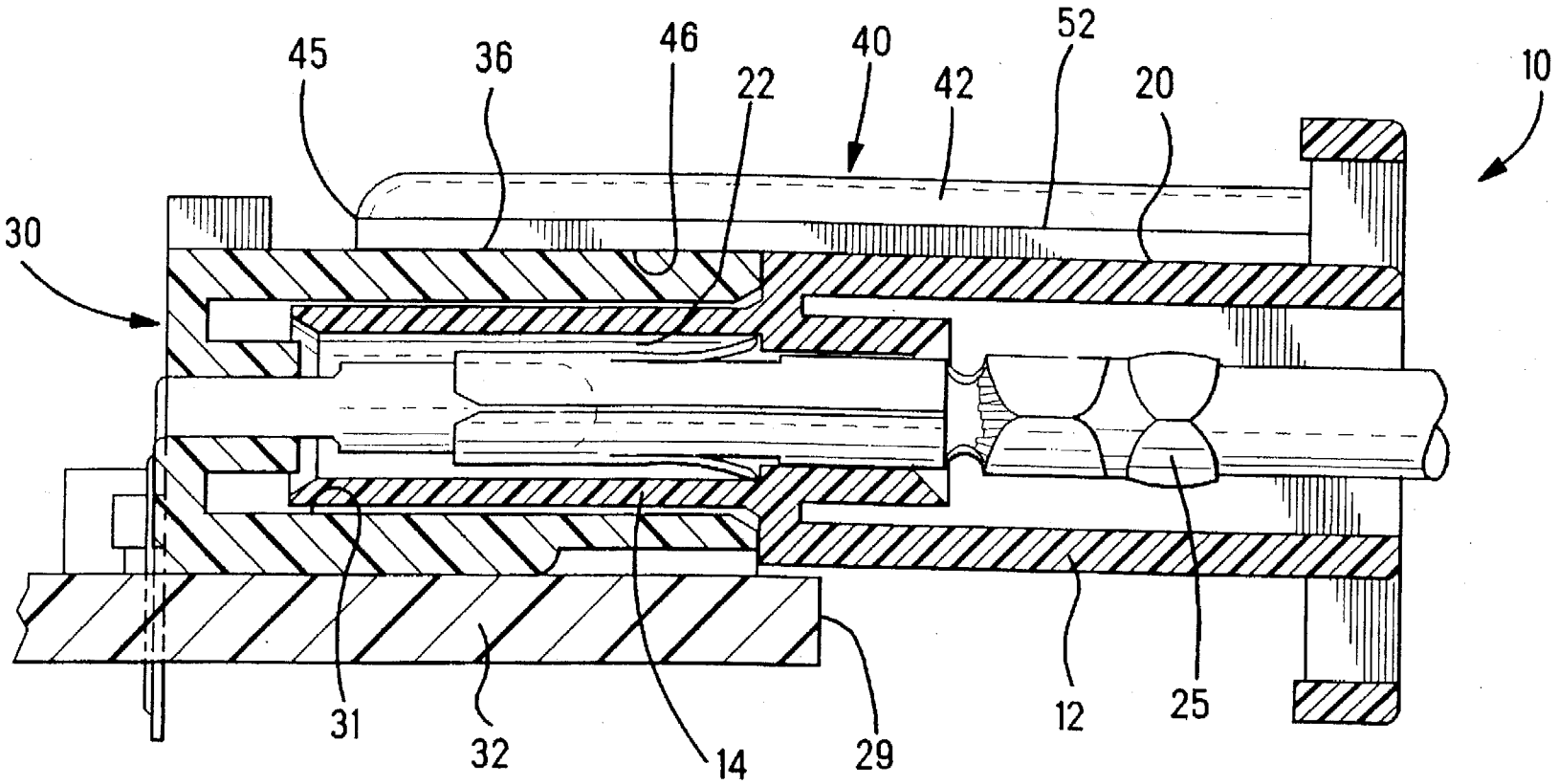
FIG. 4 is a cross-sectional view along the line 4—4 of FIG. 2.
Figure 5:
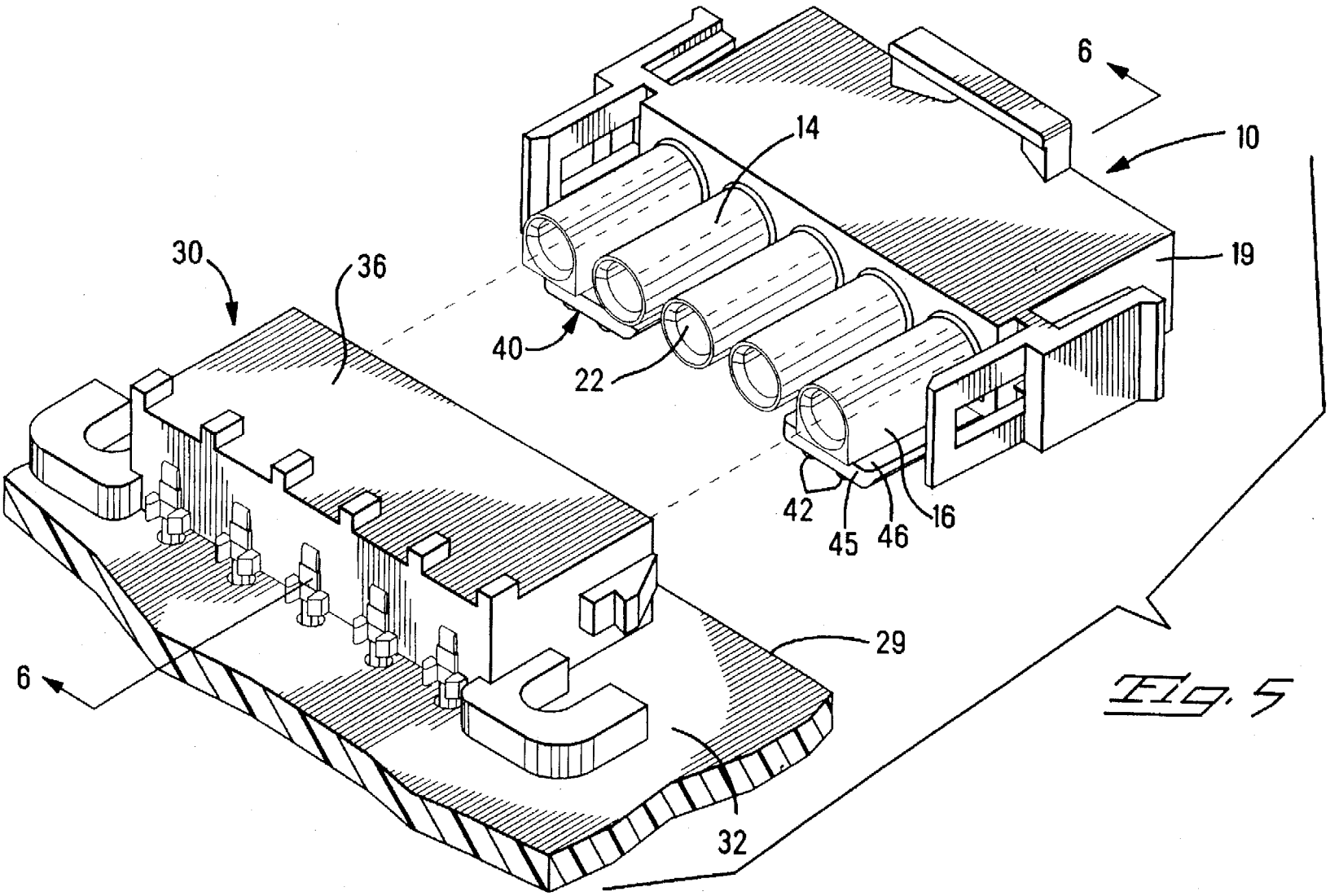
FIG. 5 is an exploded perspective view showing improper orientation of the plug connector.
Figure 6:
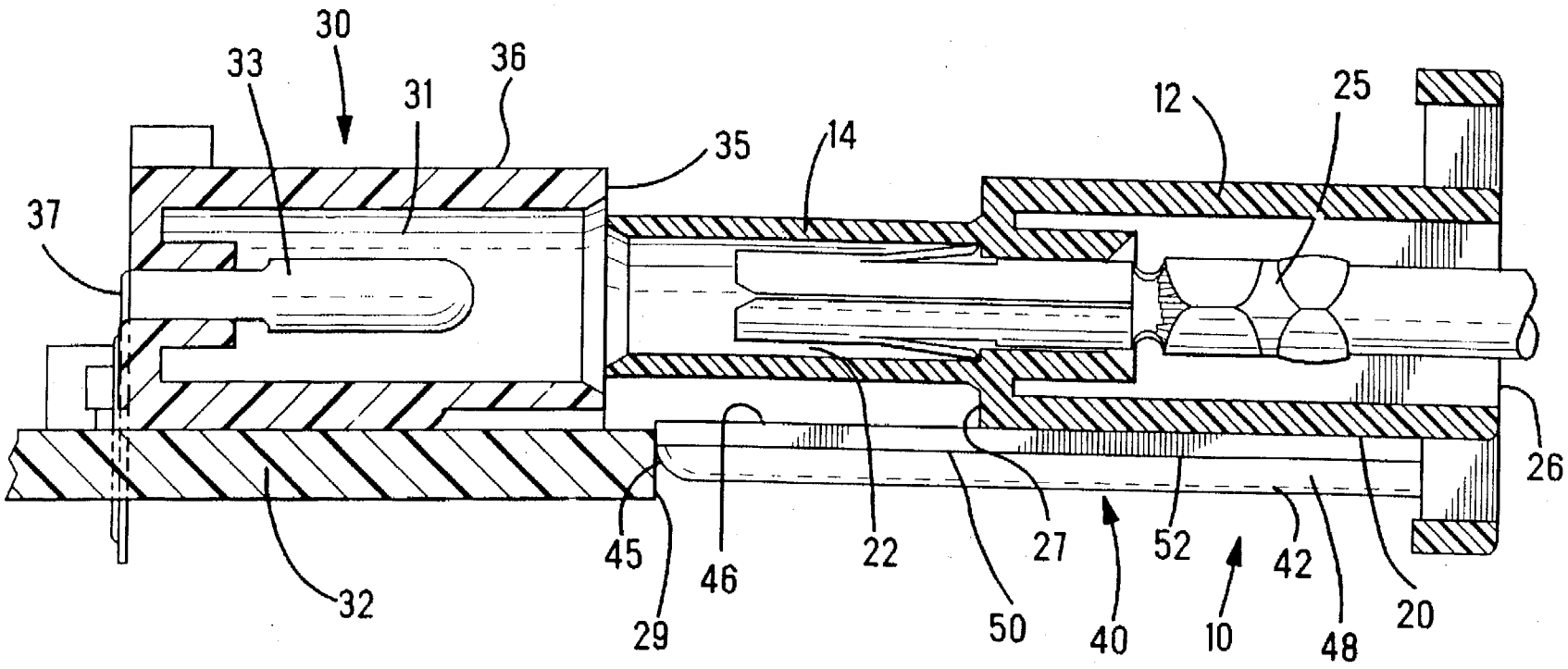
FIG. 6 is a cross sectional view showing the effect of the flange on the improper mating orientation.

Next, the mating will be described when the plug connector 10 is in the correct orientation. When mated, the bottom wall 46 of the flange 40 is received along the top wall 36 of the header connector 30, see FIG. 3. The contact silos 14 are received in passages 31 of the header connector. The D-shaped silos 16 are received within similarly shaped passages in the header connector 30. The contacts of both connectors are then in electrical connection with each other.

Under harsh, high humidity environmental conditions, it is sometimes possible for the D-shaped silos to become pliable and flexible. Therefore, under blind conditions, that is conditions in which the operator cannot see the connectors that are being mated, it is possible for the connectors to be forced together in the wrong direction despite the polarization of the D-shaped silos.

Using the current invention, when there is an attempt to improperly mate the plug connector 10 with the header connector 30, the flanges 40 will abut the front edge 34 of the circuit board. The mating face 35 of the header connector 30 is set back from the edge 29 of the circuit board 32 to the same extent as the second section 50 of the flanges 40 are shorter than the silos 14. Thus, the front edge 45 of the flange 40 will abut the circuit board 32 when leading edge of the contact silos 14 are flush with the mating face 35 of the header connector 30, thereby preventing the silos 14 from being inserted into the passages 31. The flanges 40 prevent electrical connection of the contacts 25 within the plug connector 10 with the contacts 33 within the header connector 30 because the flanges 40 engage the front edge 34 of the circuit board prior to electrical connection of the contacts. The flanges 40 act as a stop to prevent the plug connector 10 from being forced into improper connection with the header connector 30.

The flange plug connector of the present invention and many of the attendant advantages will be understood from the foregoing description. It is apparent that various changes may be made in the form, construction, and arrangement of parts thereof without departing from the spirit or scope of the invention, or sacrificing all of its material advantages.

We claim:

1. A connector for mating with a header connector on a circuit board and ensuring proper orientation during mating, comprising:

a main body having a top wall and a front wall and contact receiving passages therein; and a rigid flange, fixedly secured to said top wall and extending therealong and beyond said front wall, said flange having a front edge;

whereby when the connector is improperly oriented for mating with the header connector, said front edge of said flange acts as a stop by abutting against the circuit board to prevent mating in an improper orientation.

2. The connector of claim 1, further comprising contact receiving members extending forwardly from said front wall parallel to said flanges.

3. The connector of claim 2, wherein said flange extends from a back wall of said main body, along said top wall and beyond said front wall, and said contact receiving members extend further from said front wall than said flange.

4. The connector of claim 1, wherein a rib extends along a top wall of said flange to provide structural support to said flange.

5. The connector of claim 2, wherein one of said contact receiving members is D-shaped to provide polarization with the header connector.

6. The connector of claim 2, wherein the header connector is positioned a distance away from an edge of the circuit board, said contact receiving members extend beyond said flange by approximately the same distance as the distance the header connector is away from the edge of the circuit board.

7. The connector of claim 1, wherein another flange extends along said top wall, each of said flanges having a front edge to abut against the circuit board.

8. A connector for mating with a header connector on a circuit board and ensuring proper orientation during mating, comprising:

a main body having a top wall and a front wall;

contact receiving members extending forwardly from the front wall and having contact receiving passages therein; and a rigid flange, fixedly secured to said top wall and extending therealong and beyond said front wall and parallel to said contact receiving members, said flange having a front edge;

whereby when the connector is improperly oriented for mating with the header connector, said front edge of said flange acts as a stop by abutting against the circuit board to prevent mating in an improper orientation.

9. The connector of claim 8, wherein said flange extends from a back wall of said main body, along said top wall and beyond said front wall, and said contact receiving members extend further from said front wall than said flange.

10. The connector of claim 8, wherein a rib extends along a top wall of said flange to provide structural support to said flange.

11. The connector of claim 8, wherein one of said contact receiving members is D-shaped to provide polarization with the header connector.

12. The connector of claim 8, wherein the header connector is positioned a distance away from an edge of the circuit board, said contact receiving members extend beyond said flange by approximately the same distance as the distance the header connector is away from the edge of the circuit board.

13. The connector of claim 8, wherein another flange extends along said top wall, each of said flanges having a front edge to abut against the circuit board.

14. The connector of claim 8, wherein said contact receiving members are contact silos which are parallel but spaced apart from each other, two of said contact silos being D-shaped to provide polarization while mating with the header connector.

15. An electrical connector assembly, comprising:

a plug connector having a main body with a top wall and a front wall, contact receiving members extending forwardly from the front wall and having contact receiving passages therein, and a rigid flange, fixedly secured to said top wall and extending therealong and beyond said front wall and parallel to said contact receiving members, said flange having a front edge;

a header connector to be mounted on a circuit board, the header connector having a top wall to receive the flange therealong, whereby when the plug connector is properly oriented with the header connector during mating the flange is received along the top wall of the header connector, but when the plug connector is improperly oriented during mating, the flange will abut against the circuit board thereby preventing mating.

16. The electrical connector assembly of claim 15, wherein the contact silos extend further from the main body than the flange by a distance.

17. The electrical connector assembly of claim 16, wherein the header connector is mounted on the circuit board away from the edge of the circuit board the same distance as the flange is shorter than the silos.

18. The connector of claim 15, wherein said flange extends from a back wall of said main body, along said top wall and beyond said front wall, and said contact receiving members extend further from said front wall than said flange.

19. The connector of claim 15, wherein a rib extends along a top wall of said flange to provide structural support to said flange.

20. The connector of claim 15, wherein one of said contact receiving members is D-shaped to provide polarization with the header connector.

21. The connector of claim 15, wherein the header connector is positioned a distance away from an edge of the circuit board, said contact receiving members extend beyond said flange by approximately the same distance as the distance the header connector is away from the edge of the circuit board.

22. The connector of claim 15, wherein another flange extends along said top wall, each of said flanges has a front edge to abut against the circuit board.

23. The connector of claim 15, wherein said contact receiving members are contact silos which are parallel, but space apart from each other, two of said contact silos are D-shaped to provide polarization while mating with the header connector.

* * * * *